US006062666A

United States Patent [19]

Omata et al.

[11] Patent Number: 6,062,666

[45] **Date of Patent: *May 16, 2000**

[54] INK JET RECORDING METHOD AND APPARATUS BEGINNING DRIVING CYCLE WITH DISCHARGE ELEMENTS OTHER THAN AT ENDS OF SUBSTRATES

[75] Inventors: Kouichi Omata, Kawasaki; Yutaka Koizumi, Yokohama; Toshio Kashino, Chigasaki; Seiichiro Karita; Haruhiko Terai, both of Yokohama; Hiroki Tajima, Machida; Masaru Iketani, Zama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/552,106

[22] Filed: Nov. 2, 1995

[30] Foreign Application Priority Data

Nov. 7, 1994 [JP] Japan ..... 6-272273

[51] Int. Cl.[7] ..... B41J 29/38; B41J 2/145; B41J 2/155

[52] U.S. Cl. ..... 347/12; 347/13; 347/42; 347/40

[58] Field of Search ..... 347/40, 13, 12, 347/180, 181, 182, 42; 358/296

[56] References Cited

U.S. PATENT DOCUMENTS

| | | | |
|---|---|---|---|
| 4,463,359 | 7/1984 | Ayata et al. | 347/13 X |
| 4,922,271 | 5/1990 | Nilsson et al. . | |
| 5,016,023 | 5/1991 | Chan et al. . | |
| 5,144,341 | 9/1992 | El Haten et al. . | |
| 5,315,320 | 5/1994 | Murano | 347/180 |
| 5,357,268 | 10/1994 | Kishida et al. | 347/13 |

FOREIGN PATENT DOCUMENTS

| | | | |
|---|---|---|---|
| 0423797 | 4/1991 | European Pat. Off. . | |
| 55-132253 | 10/1980 | Japan . | |
| 58-24465 | 2/1983 | Japan | 347/180 |
| 60-44374 | 3/1985 | Japan | B41J 3/21 |
| 2002009 | 1/1990 | Japan . | |
| 4229278 | 8/1992 | Japan . | |
| 4232749 | 8/1992 | Japan . | |
| 5024192 | 2/1993 | Japan . | |

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet recording method and ink jet recording apparatus used for recording in the method. The ink jet recording apparatus has an ink jet head which is provided with a plurality of elemental substrates having a plurality of discharge energy generating elements arranged in a line. The substrates are arranged in the direction of the line. The method includes selecting blocks of discharge energy generating elements to be ready for driving one after another continuously and causing the position to start the driving cycle for the discharge energy generating elements to be at a center portion of each of the elemental substrates away from respective seamed portions between the elemental substrates.

26 Claims, 17 Drawing Sheets

200
201
202
203
204
5D
5D

HB 2, 4, 6, . . .
FOR HEAT GENERATING
ELEMENT DRIVING
ELECTRICAL VOLTAGE
GND
HEAT
BENB8
BENB7
BENB6
BENB5
BENB4
BENB3
BENB2
BENB1
LATCH

INK JET RECORDING METHOD AND APPARATUS BEGINNING DRIVING CYCLE WITH DISCHARGE ELEMENTS OTHER THAN AT ENDS OF SUBSTRATES

BACKGROUND OF THE INVENTION

1. Field of the Invention

The present invention relates to an ink jet recording method for recording by discharging recording liquid. More particularly, the invention relates to a recording method and a recording apparatus using an ink jet head structured by arranging a plurality of elemental substrates.

2. Related Background Art

A liquid jet recording method by discharging recording liquid, such as ink, from discharge ports by the utilization of thermal energy in order to cause it to fly and adhere to a paper sheet, a plastic sheet, a cloth, or other recording media. This is a recording method of non-impact type that generates less noises, and also, makes it easy to record color images, among other advantages, because there is no particular limit to the kinds of recording media to be used.

An apparatus embodying such liquid jet recording method, that is, a liquid jet recording apparatus, is simply structured comparatively. Also, with this apparatus, it is comparatively easy to perform operation at higher speeds because, among other advantages, its liquid jet nozzles can be arranged in higher densities.

Therefore, the liquid jet recording method described above has attracted public attention, with the result that many studies and researches on the method are being carried on. As a matter of fact, several kinds of liquid jet recording apparatuses that embody the liquid jet recording method are currently on the market and practically in use.

Now, in the field where recording is practiced using the liquid jet recording method, it has been desired in recent years to materialize the earlier provision of a recording apparatus capable of recording in higher quality of recorded images at higher speeds. With a view to complying with the request for higher speed recording, studies have been made assiduously on a large-sized recording head, the so-called line head that provides a recording width corresponding to the width of a recording medium to be used so as to make recording possible on a wider recording media.

For such line recording head, however, it is extremely difficult to perfectly process the discharge energy generating elements, driving circuits and the like to drive them, which should be provided to cover almost the entire width of the recording area. Like this, the difficulty lies in enhancing the production yield of this type of recording head.

In other words, for a line recording head that records on an A3 sized recording sheet with a recording density of 400 DPI (dot per inch), it is necessary to process 4,736 discharge energy generating elements (each comprising a pair of electrodes and a heat generating resistor between them for the bubble jet method) without even a single defect: everyone of them should be perfectly processed, hence making its production extremely difficult. As a result, the head costs are so high that it is far beyond practical use.

In order to solve the problem, various methods have been proposed as disclosed in Japanese Patent Laid-Open Application No. 55-132253, Japanese Patent Laid-Open Application No. 2-2009, Japanese Patent Laid-Open Application No. 4-229278, Japanese Patent Laid-Open Application No. 4-232749, Japanese Patent Laid-Open Application No. 5-24192, U.S. Pat. No. 5,016,023, among others. The technical thought of the proposals disclosed in them is to adopt a method wherein a plurality of heads, each provided with a small number of nozzles comparatively easy to be processed such as 32, 48, 64, or 128 nozzles, are arranged in high precision on one base board (or on both faces thereof) in accordance with the required density of nozzles to be provided. However, for an arrangement of the kind, it is required to provide a plurality of heads arranged in high precision for the formation of a constituent capable of directing ink discharges uniformly. As a result, there is a need for the provision of various devices or apparatuses dedicated to making such arrangement. Also, it is necessary to supply ink and driving signals to each of the heads that form such constituent, respectively. Therefore, it is inevitable that the number of parts will increase so that the recording head necessarily becomes larger and the manufacturing costs rise. Thus, even if the performance of such head is made sufficiently high, the cost and size of the liquid jet recording apparatus using a head of the kind still impede creating more demands on the market.

To cope with this situation, there is proposed a method in which a plurality of substrates (hereinafter referred to as heater boards), each provided with a comparatively small number of discharge energy generating elements, such as 64 or 128 (each of which comprises a pair of electrodes and a heat generating resistor between them for the ink jet recording method), are arranged and bonded on one base board in good precision as required.

In accordance with this method, it is possible to obtain, in a high production yield, an elongated head that has hitherto been attempted to be produced by the application of a technique such as photolithographing process in anticipation of covering the entire recording width without even a single defective element.

In this respect, an ink jet head to which this method is applied is such that a ceiling board is integrally formed with a plurality of ink discharge ports arranged for its one end, and also, with a plurality of grooves conductively connected to each of the discharge ports, which are extended from one end to the other end, and that this ceiling board is joined to a plurality of heater boards so as to cover the heater boards with the plurality of grooves formed on the ceiling board.

FIG. 1 is a view which schematically illustrates the timing to drive the ink jet head whose elongation is implemented by the application of the structure described above, as well as its driving positions. Reference marks HB1, HB2, . . . designate each of the heater boards (elemental substrates) arranged. The mark ○ schematically represents each dot to be printed. The indications directed from the top to the bottom in FIG. 1 represents the elapse of time. It may be possible to consider that the mark ○ is not necessary confined to only one dot, but it indicates plural dots that are driven at a time. With the head structured as described above, one or several numbers of nozzles are driven as a group from one end of the heater board, and then, printing signals are given continuously to drive them one after another toward the other end. It is thus arranged to terminate the driving of one cycle (one cycle from A to B) at the other end. Such driving is actuated for each of the heater boards at a time.

However, when observing prints obtained by recording performed by the driving method described above, it is found that density unevenness and displacement of impacted points are conspicuous in the vicinity of each seamed portion of heater boards of the recording head. FIG. 2 shows such state as this.

As described earlier, the recording head of the present invention is structured by providing a plurality of heater boards in the arrangement direction of a plurality of discharge energy generating elements. Therefore, printing disturbance tends to occur on each end portion (each seamed portion) of the heater boards. The present inventors have studied and examined repeatedly to ascertain the causes to bring about such printing disturbance, and obtained the following knowledge:

At first, it is conceivable that the structure of the head itself causes such disturbance for the reasons given below. Depending on the degree of precision in which heater boards are cut; the degree of precision in which the heater boards are arranged; the difference of steps or the like often exists in the thickness direction between heater boards, it is not easy to obtain the perfect close contact between the walls of a ceiling board 200 that constitute liquid paths, and the heater boards 100 over each of the seamed portion between the heater boards. FIG. 3 illustrates such state as this. As shown in FIG. 3, if there is a gap s between the wall 201 that constitutes a liquid path, and the heater board 100, the pressure exerted for the execution of printing escapes therefrom, hence reducing the amount of discharge from the respective orifice. As a result, the density unevenness is brought about, and at the same time, the discharging speed thereof is caused to slow down, hence displacing the point of impact.

Also, due to fine differences between the characteristics of each heater board, there occurs difference as to the average printing density per heater board. Thus, at each seamed portion between heater boards, the difference of density becomes conspicuous.

Secondly, it is conceivable that the driving method applied to recording brings about the disturbance. If the method of driving described above is adopted, that is, while arranging eight or sixteen nozzles as a block, the nozzles are driving per heater board one after another from one end to the other continuously, there tends to occur the reduction of discharge amount and discharging speed with respect to the nozzles at the start of driving and the termination thereof. This is due to the fact that when pressure is exerted by foaming of ink on the respective heat generating unit, such pressure is caused to reach the common liquid chamber arranged behind nozzles, but for the nozzles at end portions, it is easier for such pressure to escape backward because there is no foaming taking place in its adjacent nozzles. Conceivably, therefore, the pressure that should be directed toward the respective orifices becomes less intensified to the extent that the pressure escapes backward.

Also, in accordance the driving method described above, it takes a time t after the nozzle at the one end of each heater board (last nozzle B) has been driven until the nozzle on the other end thereof (first nozzle A) is driven. (This time may be referred to as a time between cycles). During this period of time, the relative position of the recording head and recording sheet is caused to shift. Therefore, on the recording sheet, dots are recorded in the stepped form per driving cycle for each seamed portion between heater boards, thus making such portions more conspicuous.

Because of various factors described above, which are superposed on each seamed portion between the heater boards, it becomes difficult to provide prints uniformly over the entire width of the recording head thus arranged. The resultant quality of recorded images is found yet to be improved.

SUMMARY OF THE INVENTION

It is an object of the present invention to solve the problem encountered in recording by use of an elongated head formed by a plurality of elemental substrates arranged in line as described above.

What is required first is to remove each of the causes of unevenness brought about over prints, but there is limit to the improvement of the precision in which the heater boards are cut and arranged, or the like, and at the same time, if extremely high precision is made necessary, the reduction of production yield is invited, leading to exceptionally high costs after all.

Therefore, in order to reduce the unevenness of prints while suppressing increase in costs, it is effective to shift the starting point of driving cycle from the seamed portion between heater boards or to arrange driving the heat generating elements positioned close to each of the seamed portions simultaneously (or essentially at a time) or continuously, respectively. Also, it is more effective to start driving heaters from the location other than the end portion of the respective heater board (from the center thereof, for example). In this way, it is possible to disperse the positions where print unevenness resulting from the structure of head itself as well as from the driving of the heater boards, and then, to make the unevenness of prints less conspicuous visually.

Such driving method of the present invention includes the following:

An ink jet recording method for recording by selecting the adjacent discharge energy generating elements between the adjacent elemental substrates simultaneously or continuously to make them ready for driving by use of an ink jet head provided with a plurality of elemental substrates having a plurality of discharge energy generating elements formed in line, the substrates being arranged in the direction of such line on the head.

Or an ink jet recording method for recording by selecting a plurality of discharge energy generating elements formed for each of the elemental substrates to be made ready for driving in one cycle, and also, by selecting the position of discharge energy generation to make the aforesaid driving cycle ready for driving beginning with the discharge energy generating element other than those arranged in the end portions of such elemental substrate.

Also, an ink jet recording apparatus of the present invention comprises a control circuit that selects the ink jet head having a plurality of elemental substrates, each provided with a plurality of discharge energy generating elements arranged in line, the substrates being arranged in the direction of such line, and the adjacent discharge energy generating elements between the adjacent elemental substrates simultaneously or continuously to make them ready for driving.

Or an ink jet recording apparatus of the present invention comprises a control circuit that selects the ink jet head having a plurality of elemental substrates each provided with a plurality of discharge energy generating elements arranged in line, the substrates being arranged in such line, and a plurality of discharge energy generating elements arranged for the respective elemental substrates continuously to make them ready for driving in a cycle, and also, selects the position of discharge energy generation to make the aforesaid driving cycle ready for driving beginning with the discharge energy generating element other than those arranged in the end portions of such elemental substrate.

BRIEF DESCRIPTION OF THE DRAWINGS

FIG. 5D is a cross-sectional view, taken along line 5D—5D in FIG. 5B.

DETAILED DESCRIPTION OF THE PREFERRED EMBODIMENTS

Figure 4:
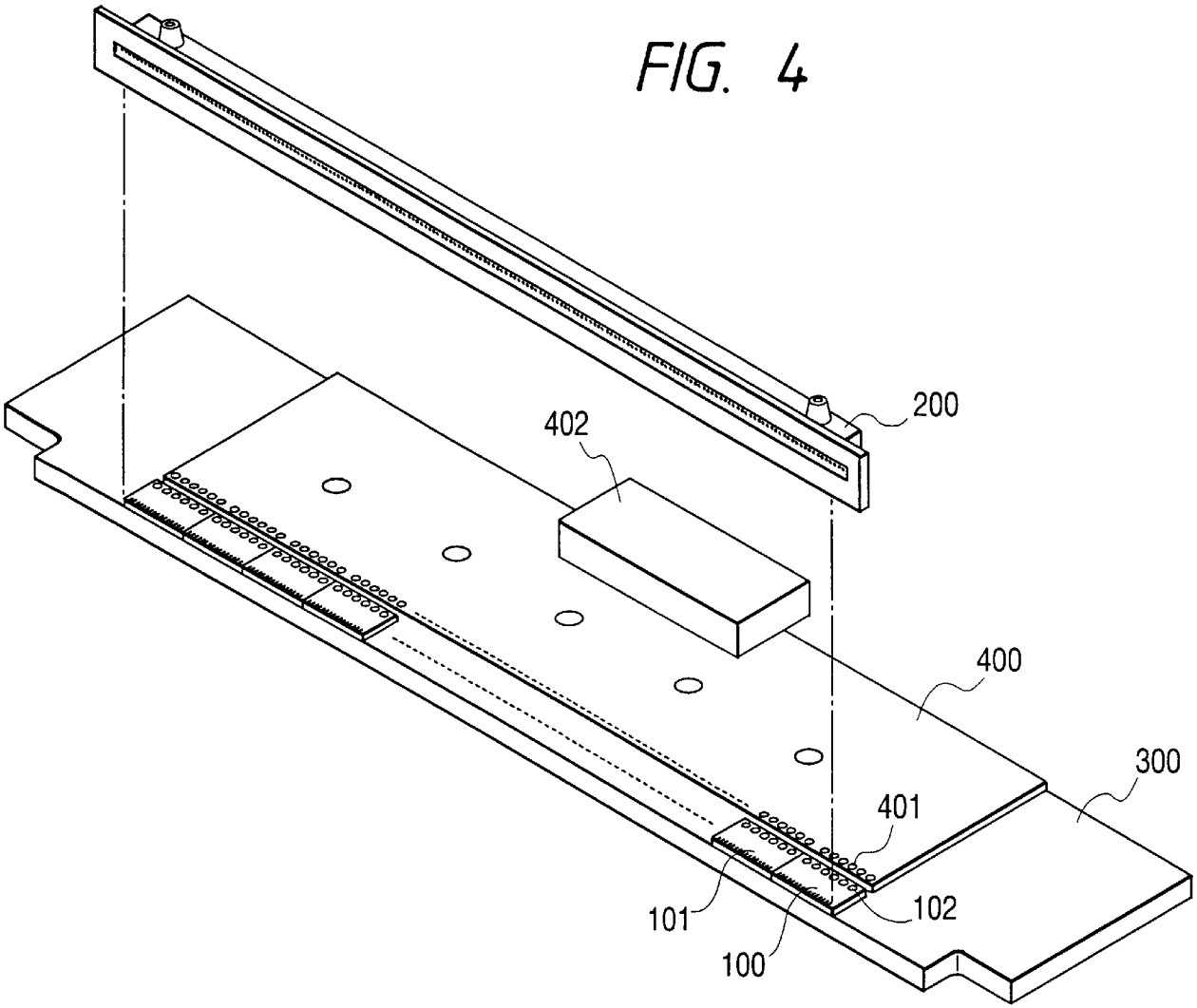
FIG. 4 is a perspective view which schematically shows an ink jet head in accordance with the present invention.
Figures 5A, 5B, 5C, 5D:
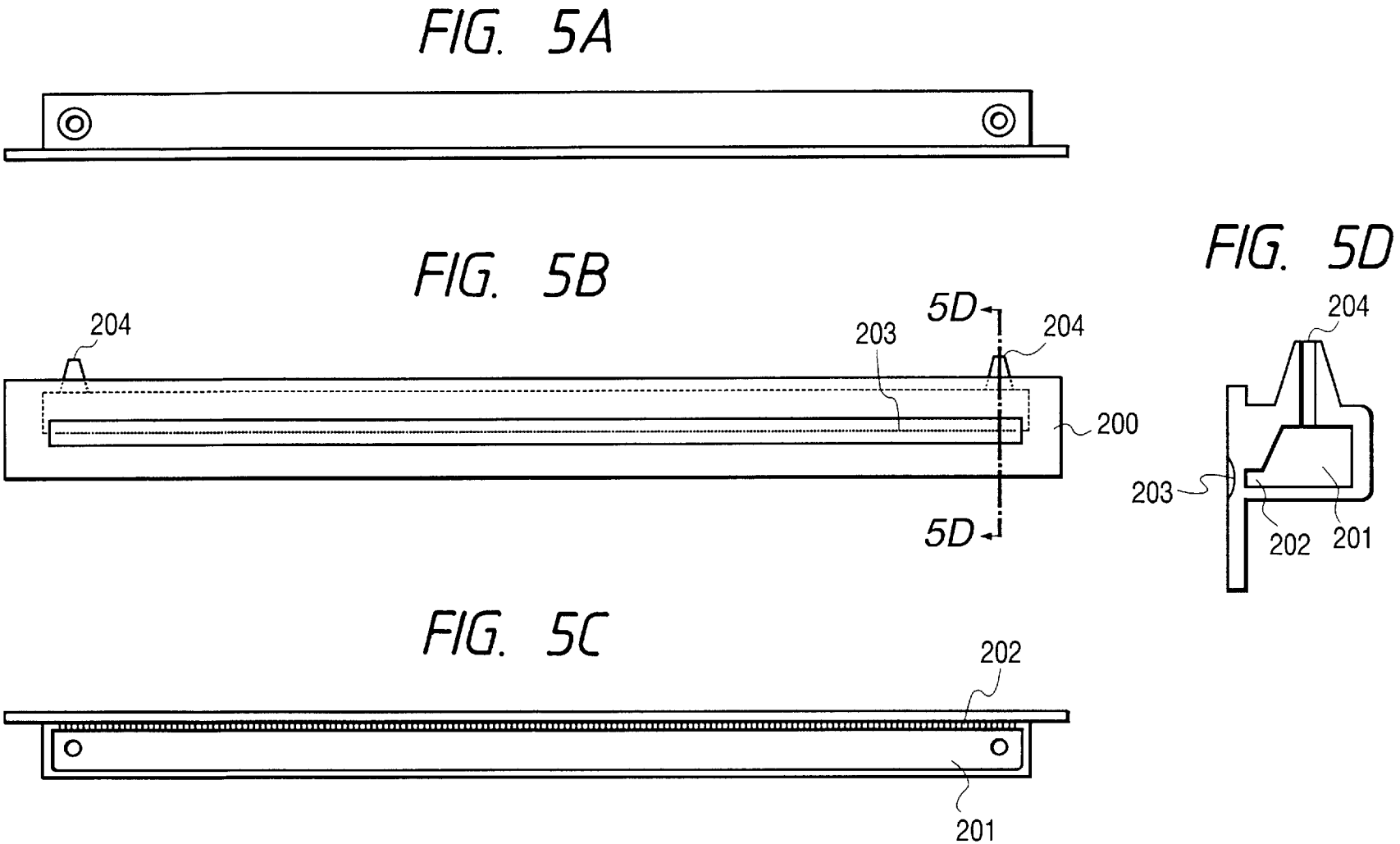
FIGS. 5A to 5D are views schematically showing a grooved member in accordance with the present invention.

FIG. 4 shows an ink jet head used for the present embodiment. This head is an ink jet recording head whose density of discharge ports is 360 dpi (70.5 $\mu$m pitch), having 1,344 discharge ports.

In FIG. 4, 128 heater boards (elemental substrates) 100 are arranged in line, each provided with discharge energy generating elements 101 in a density of 360 dpi. On each of the elements, there are arranged signal pads for driving the discharge energy generating elements 101 at an arbitrary timing by the application of electric signals from the outside, and power pads 102 and others for supplying power to drive them.

Eleven heater boards 100 are adhesively bonded for fixation by means of bonding agent 301 to the surface of a base plate 300 of stainless steel serving as a supporting base board in the arrangement direction of the discharge energy generating elements.

On the base plate 300, a printed circuit board 400 is adhesively bonded the same as the heater boards 100. Here, the circuit board 400 is bonded to place the signal and power supply pads 401, which are arranged on the circuit board, as well as the pads 102 on the heater boards 100 so as to present a given positional relationship. Also, on the printed circuit board 400, a connector 402 is provided to supply printing signals and driving power received from the outside.

Now, the grooved ceiling board (grooved member) 200 will be described.

The grooved ceiling board 200 shown in FIGS. 5A to 5D is integrally formed with grooves 202 arranged corresponding to the discharge energy generating elements 101 provided for the heater boards 100 to constitute liquid paths; orifices 203 each arranged for each of the liquid paths and conductively connected with each of the liquid paths, respectively, for discharging ink onto a recording medium; an ink supply port 204 for causing ink supplied from an ink tank (not shown) to flow into each of the liquid paths 202; and a recess 201 constituting a common liquid chamber to receive ink that has flowed in through the ink supply port 204, thus supplying ink to each of the liquid paths. In this respect, the through holes of the discharge ports are formed by the application of laser beam.

The grooved ceiling board 200 is of course formed in a length that substantially covers the alley of the discharge energy generating elements formed by a plurality of heater boards 100 arranged in line.

The grooved ceiling board 200 is joined with the base plate 300, while keeping a given positional relationship between the paths 202 and the discharge energy generating elements on the heater boards 100 arranged on the base plate.

Here, the method is adoptable in various modes for joining the grooved ceiling board with the heater boards, such as mechanically compressing the grooved ceiling board by means of spring or the like, fixing them by use of a bonding agent, or combining these mechanical and bonding modes, among others.

Figure 6:
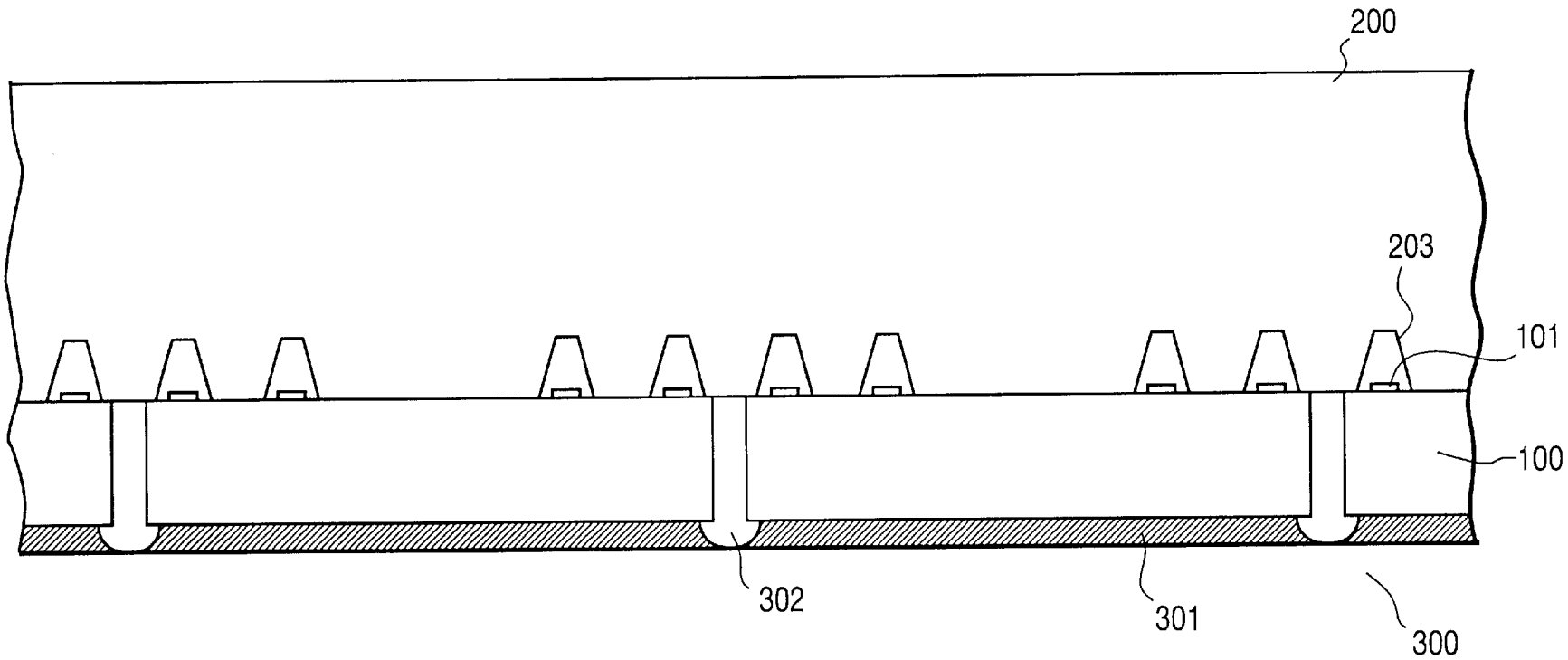
FIG. 6 is a view which schematically shows the positional relationship between a grooved member and elemental substrates.

In this way, the grooved ceiling board 200 and heater boards 100 are fixed with the relationship represented in FIG. 6. FIG. 6 is a cross-sectional view which shows liquid paths, observed in the direction of orifices.

Hereinafter, the specific description will be made of a recording method in accordance with the present invention.

FIGS. 7A to 7D are views which schematically show the driving timing and the driving positions of discharge energy generating elements by the representation of printed dots.

The reference marks HB1, HB2, . . . designate each of the heater boards arranged, and the mark ○ schematically designates dots to be printed. The indications directed from the top to the bottom represent each elapse of time. In this respect, the mark ○ is not necessarily confined to the representation of single dot, but it may be possible to consider that it represents a plurality of dots to be driven at a time, such as 4, 8, 16, 32 dots, or the like.

Figure 1:
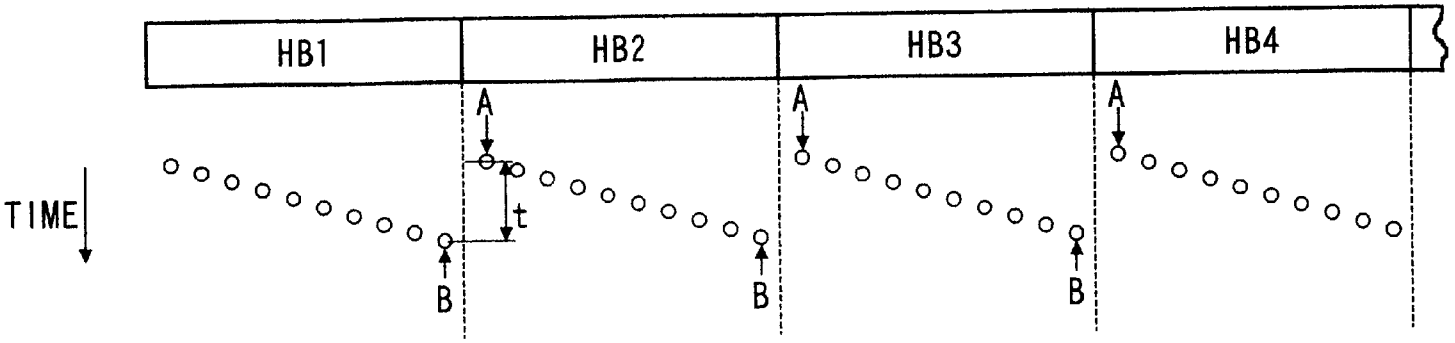
FIG. 1 is a view which schematically shows the driving timing and the driving positions in accordance with the related art.
Figure 2:
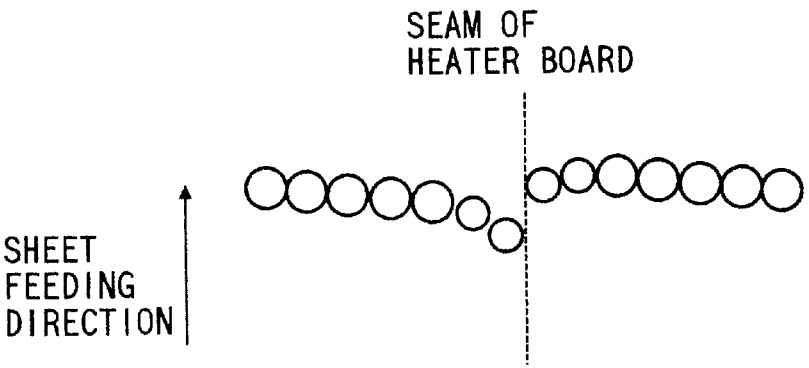
FIG. 2 is a view which schematically shows the printed dots in the vicinity of a seam of elemental substrates in accordance with the related art.
Figure 3:
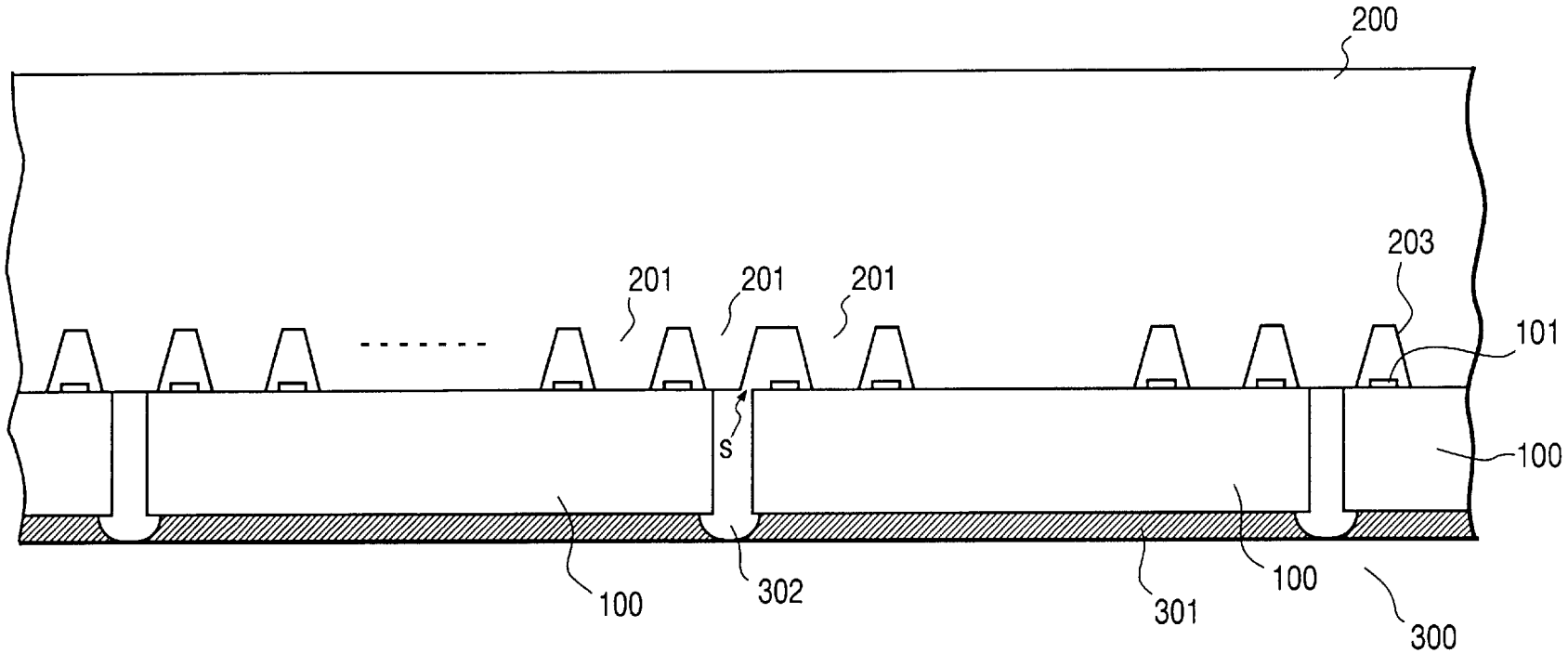
FIG. 3 is a view which schematically shows the positional relationship between nozzles and elemental substrates in accordance with the background art.
Figures 7A, 7B, 7C, 7D:
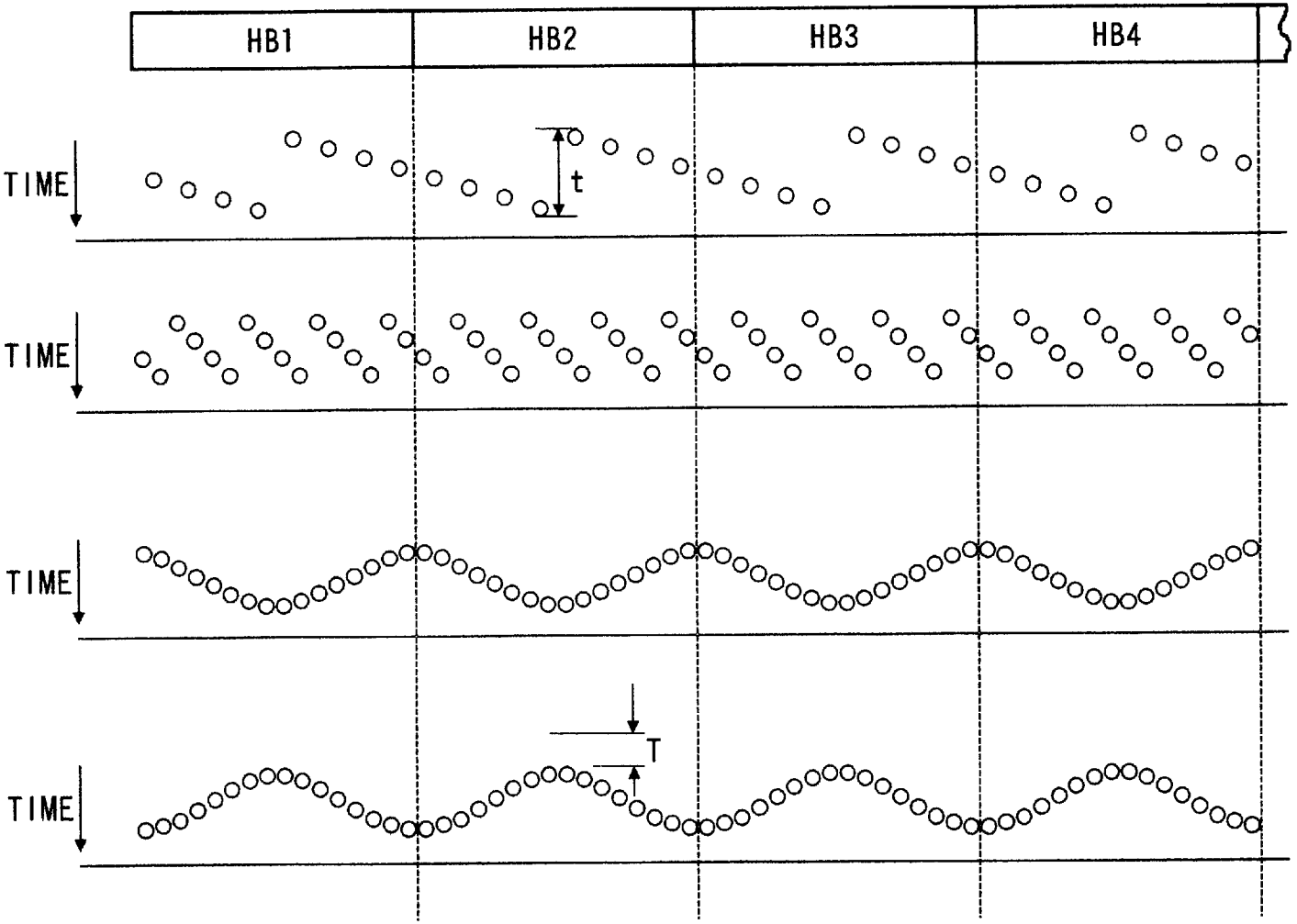
FIGS. 7A to 7D are views which schematically show the driving timing and driving positions in accordance with the present invention.
Figure 8:
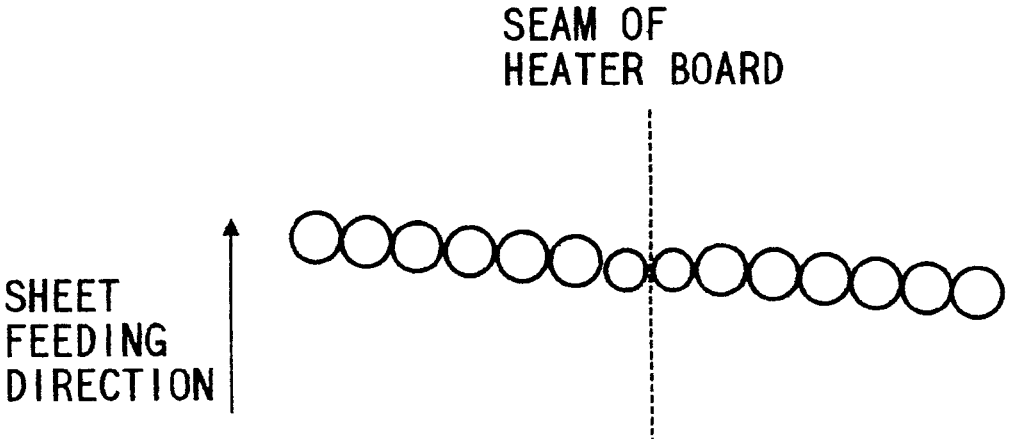
FIG. 8 is a view which shows one example of printed dots in accordance with the present invention.

In accordance with one example of the related art shown in FIG. 1, each seamed portion between heater boards and starting position (which lies on the seamed portion) of the driving cycle are agreed with each other, because printing signals are applied from one end to the other end as the time elapses. However, in accordance with the embodiment represented in FIG. 7A, the cycle of the seamed portions between the heater boards and the starting of the driving cycle are arranged to be disagreed so that the printing signals are applied starting with almost the central part of each heater board and causes them to drive one after another to the right-hand end in FIG. 7A. Then, the printing signals are applied from the left-hand end in FIG. 7A toward the central part. To drive in this way, it is possible to shift the region, in which the reduction of discharging amount occurs due to each seamed portion between heater boards, from the portion where prints present difference in the form of steps due to the difference in timing t between the start and termination of driving or from the portion where dots are displaced at the start and end of driving as described in conjunction with the related art. FIG. 8 shows the printing condition at that time. In this way, the unevenness of the discharging amounts, and the uneven prints caused by the displacement of impact points are dispersed. Thus, these unevennesses are not concentrated on one seamed portion. Therefore, it is possible to obtain images in good condition without any conspicuous unevenness visually noticeable.

Figure 9:
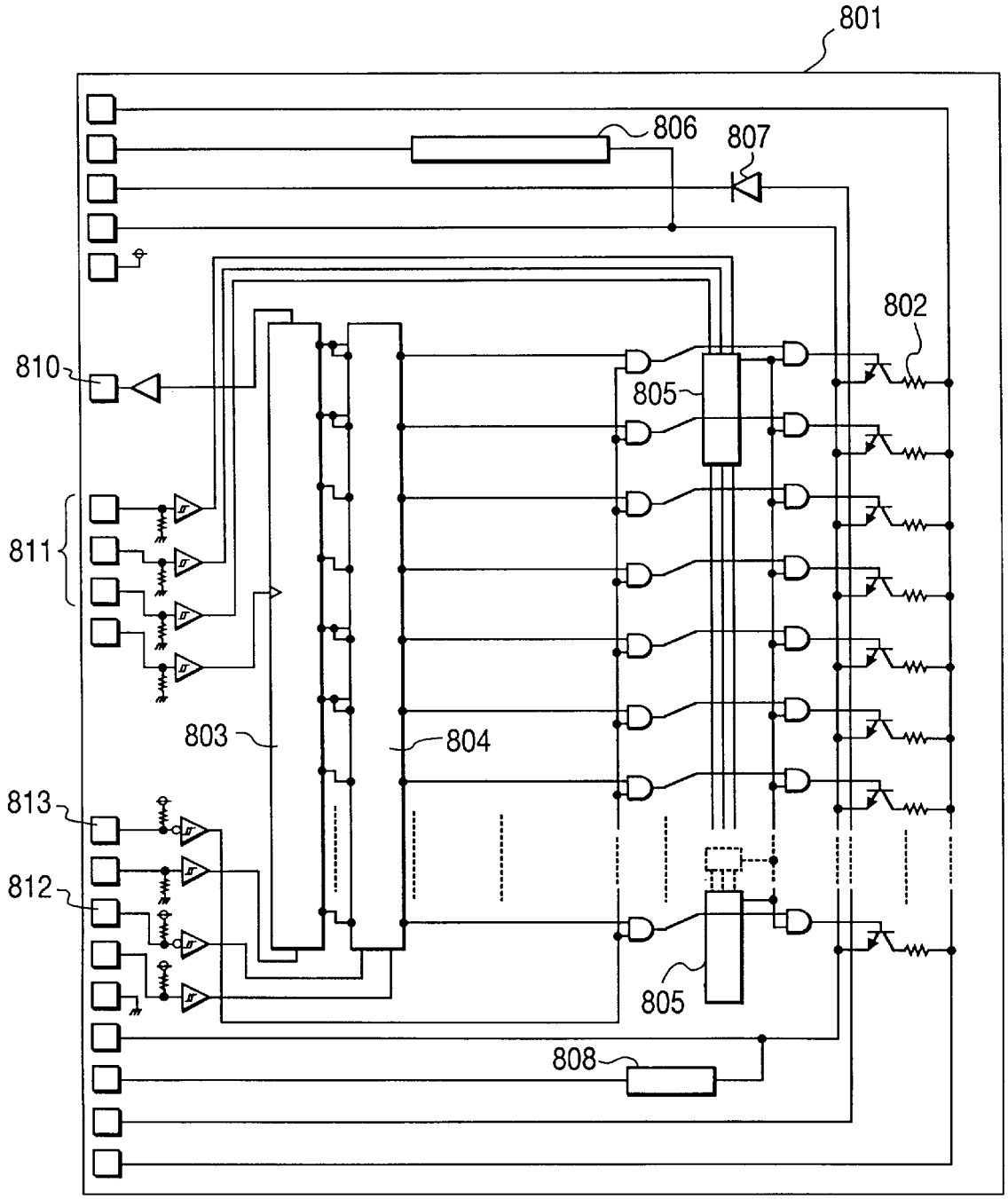
FIG. 9 is a view which schematically shows an equivalent circuit for the elemental substrates in accordance with the present invention.

FIG. 9 is a view which shows the equivalent circuit arranged on an elemental substrate 801 that forms a recording head in accordance with the present embodiment (the driving example illustrated in FIG. 7A). 128 electrothermal transducing elements (heaters) 802 are arranged in line as discharge energy generating elements. Sixteen heaters form one block (and eight blocks in total). The heaters are selected to be ready for driving almost simultaneously. The selection and driving per block are repeated eight times one after another to complete one cycle of selection and driving. In FIG. 7A, one dot represents the eight heaters that can be driven at a time.

Image data are arranged on shift registers 803 when received from the apparatus main body through the connecting pad 810. When 128-bit data are arranged, latch pulse is inputted into the latch circuit 804 through the pad 812. Along this input, the data arranged on the shift register 803 are brought into the latch circuit 804.

It is arranged to select the discharge energy generating elements of one block to be ready for driving by receiving the signals output from the control circuit on the ink jet recording apparatus side by use of 3–8 decoders 805 through the pad 811.

For the present embodiment, control signals are output from the control circuit so that driving is executed as shown in FIG. 7A.

Now, in order to make the circuit formed on the elemental substrate shown in FIG. 9, as well as the driving method of the present embodiment more easily understandable, the description will be made further in detail using the equivalent circuit represented in FIG. 10 and the example of signal waveforms shown in FIG. 11.

Figure 10:
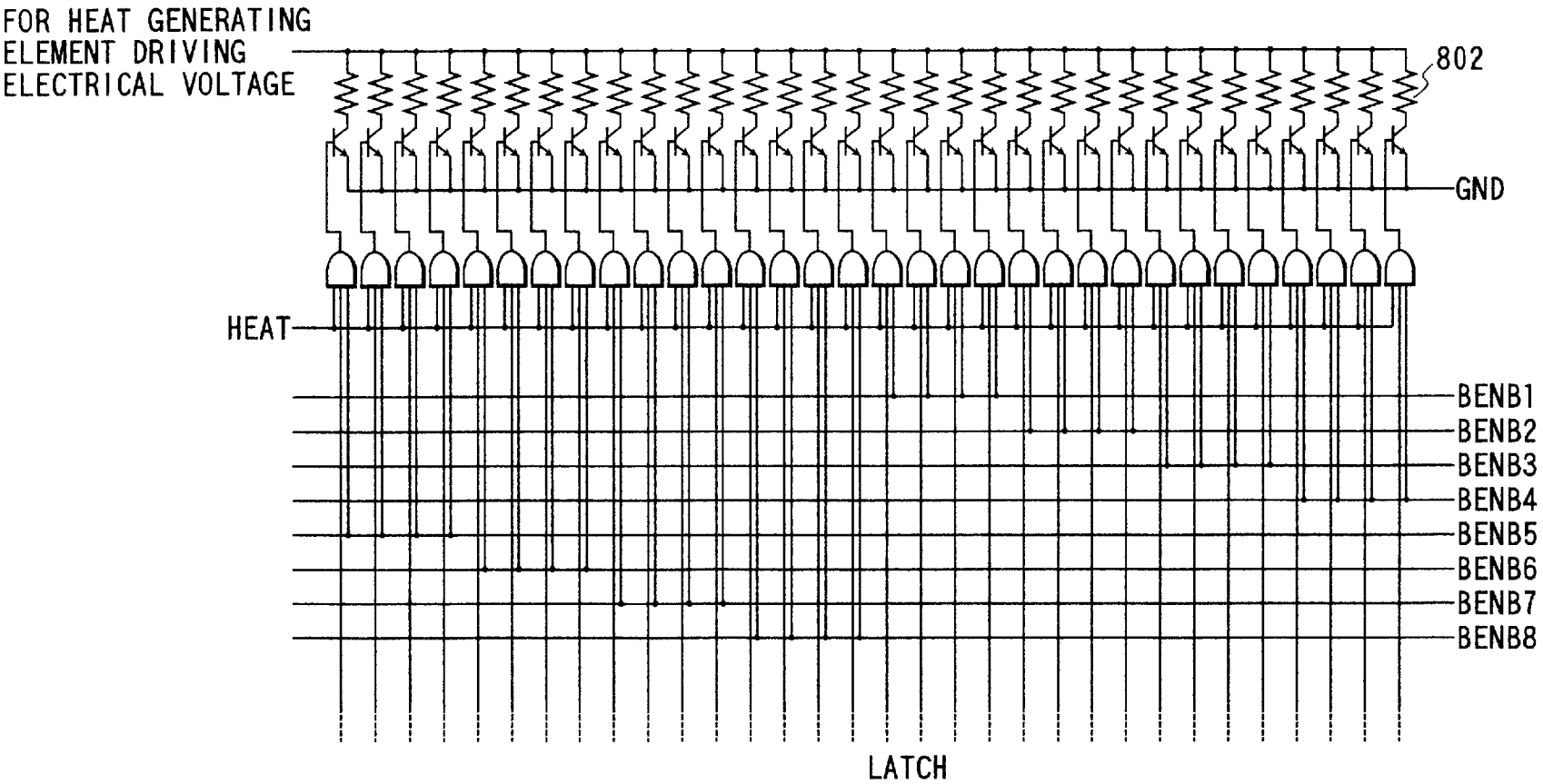
FIG. 10 is a view which schematically shows an equivalent circuit for the elemental substrates in accordance with the present invention.
Figure 11:
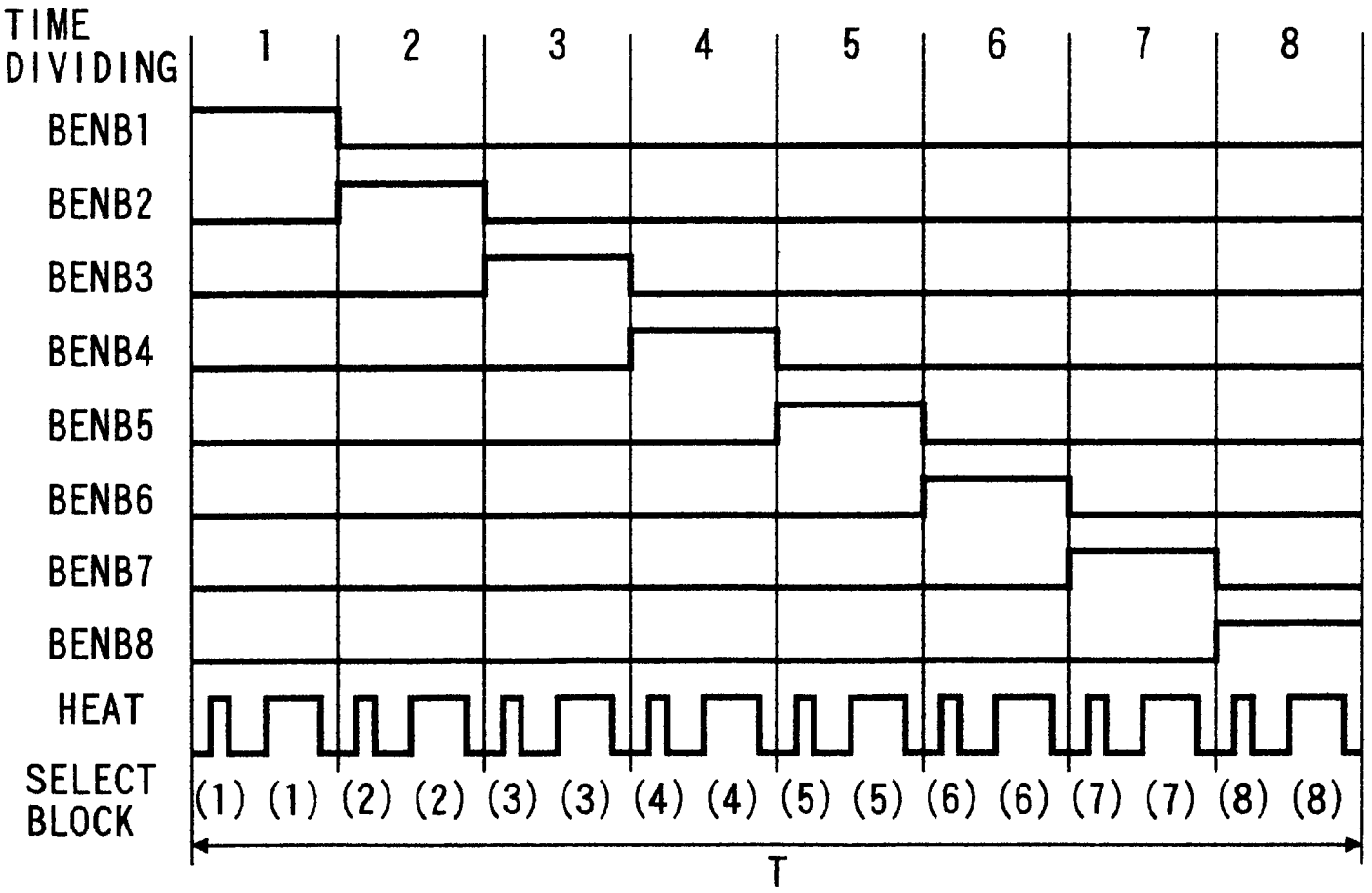
FIG. 11 is a view which shows the wave form of driving signal in accordance with the present invention.

FIG. 10 is a simplified view showing the driving circuit in the vicinity of the electrothermal transducing elements 802 formed on the circuit shown in FIG. 9 (the electrothermal transducing elements on the side closer to the latch). Here, the 3–8 decoders are represented by the developed circuit thereof (using eight enable lines) for simplification. Each of the enable lines (BENB1 to BENB8) of the circuit shown in FIG. 10 receives signals as shown in FIG. 11, respectively. At first, when signal is inputted into the BENB1 enable line during the first divisional time, four electrothermal transducing elements on the right side in the vicinity of the central part are selected to be ready for driving. Then, as signal is inputted into the BENB2 enable line during the second divisional time, four electrothermal transducing elements on the right side of the four previously selected are now selected to be ready for driving. In this way, from the central part of FIG. 10 to the right-hand side thereof, four electrothermal transducing elements are selected to be ready for driving one after another. Then, from the left end side of FIG. 10 to the central part thereof, the selections are executed likewise.

Here, whether or not the selected electrothermal transducing elements are actually driven is determined by the presence or absence of the heating signal input that is applied to deciding on the driving period required.

In FIG. 7A referred to earlier, each four electrothermal transducing elements shown in FIG. 10 are represented as one dot.

Thus, in accordance with the present embodiment, the electrothermal transducing elements positioned on the end portion of each elemental substrate are selected to be ready for driving continuously with the electrothermal transducing elements positioned on the end portion of the adjacent elemental substrate. Then the driving is actuated so that the position of the electrothermal transducing elements where the driving cycle begins and the position of the electrothermal transducing elements where the cycle terminates (that is, junction of driving cycles) are in the vicinity of the central part, that is, a position different from the seamed portion of the elemental substrates. As a result, it is possible to disperse the unevenness resulting from the structure of the head itself, and the unevenness caused by driving, hence visually improving the quality of recorded images.

Now, the description will be made of an embodiment using a driving method shown in FIG. 7B.

In accordance with the present embodiment, the numbers of electrothermal transducing elements are divided into four blocks, and each of them is driven within one cycle.

Figure 12:
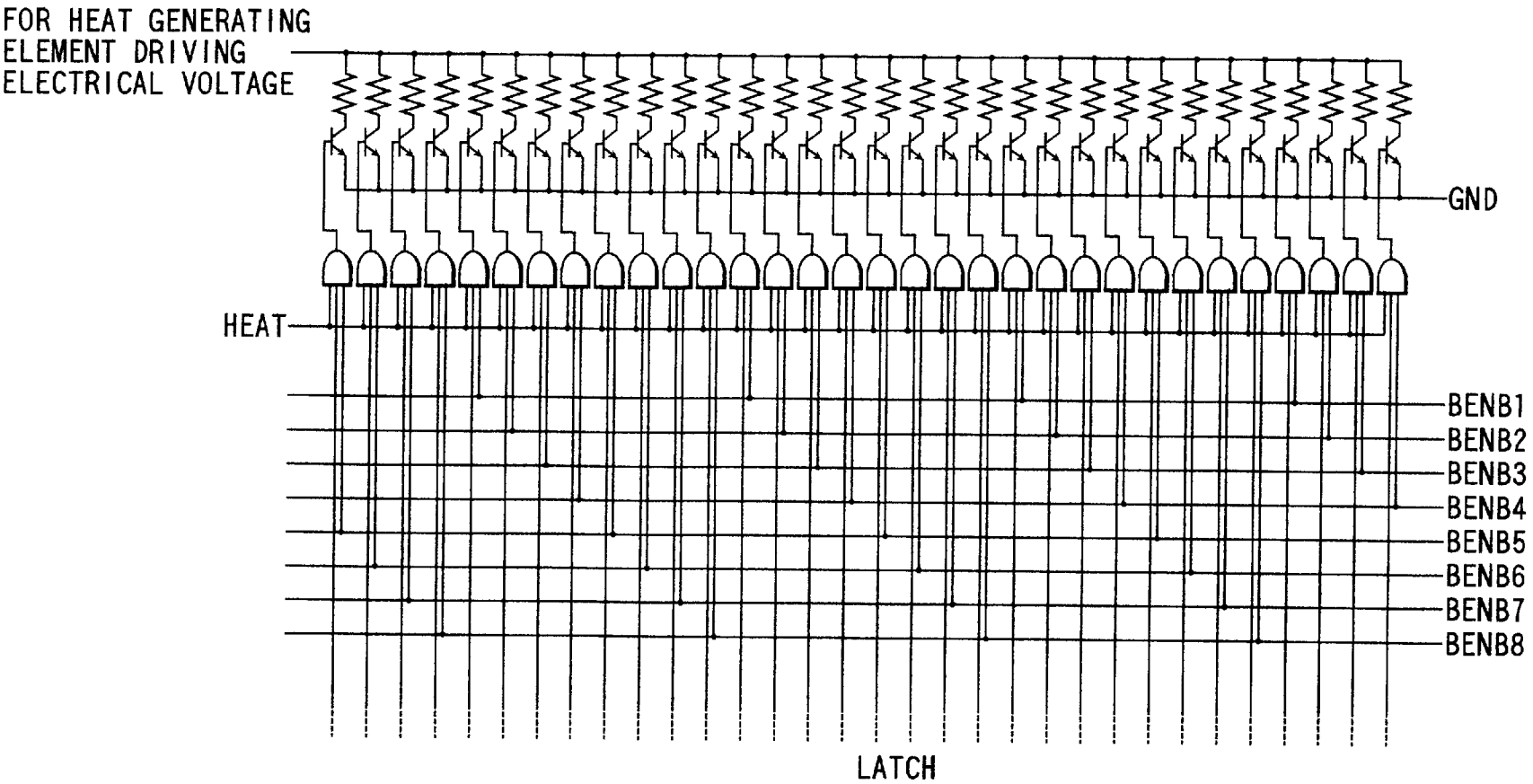
FIG. 12 is a view which schematically shows the equivalent circuit of the elemental substrates in accordance with the present invention.

FIG. 12 shows the principal part of the circuit formed on the elemental substrate for executing such driving.

When the same driving signal as applied in the previous embodiment (the driving signal shown in FIG. 11) is applied to this circuit, the following driving is executed:

Four electrothermal transducing elements arranged in the first position of each of the blocks are selected to be ready for driving simultaneously, and then, the electrothermal transducing elements on the right-hand side thereof are selected one after another to be ready for driving.

For the present embodiment, too, the driving is executed so that the starting and terminating positions of driving of the electrothermal transducing elements are not caused to agree with the seamed portion of the elemental substrates, thus making it possible to obtain the same effect as the previous embodiment.

In this respect, while the description is made of the example in which the elements are divided into four blocks, it may be possible to divide them into ¼, ⅙, ⅛, or the like or into one block as a unit, which is longer than the length of one elemental substrate, because it is possible to obtain the same effect by arranging the starting position of driving cycle to be different from the seamed portion of the elemental substrates.

Now, the description will be made of an embodiment using the driving method shown in FIG. 7C.

For the present embodiment, it is, at first, arranged to drive almost at a time the electrothermal transducing elements corresponding to a plurality of nozzles having the seamed portion of the heater boards between them. Then, plural nozzles adjacent to them are driven one after another toward the center of each heater board in accordance with this driving method.

Here, in FIG. 7C, one dot represents the plural electrothermal elements to be driven at a time.

Figure 13:
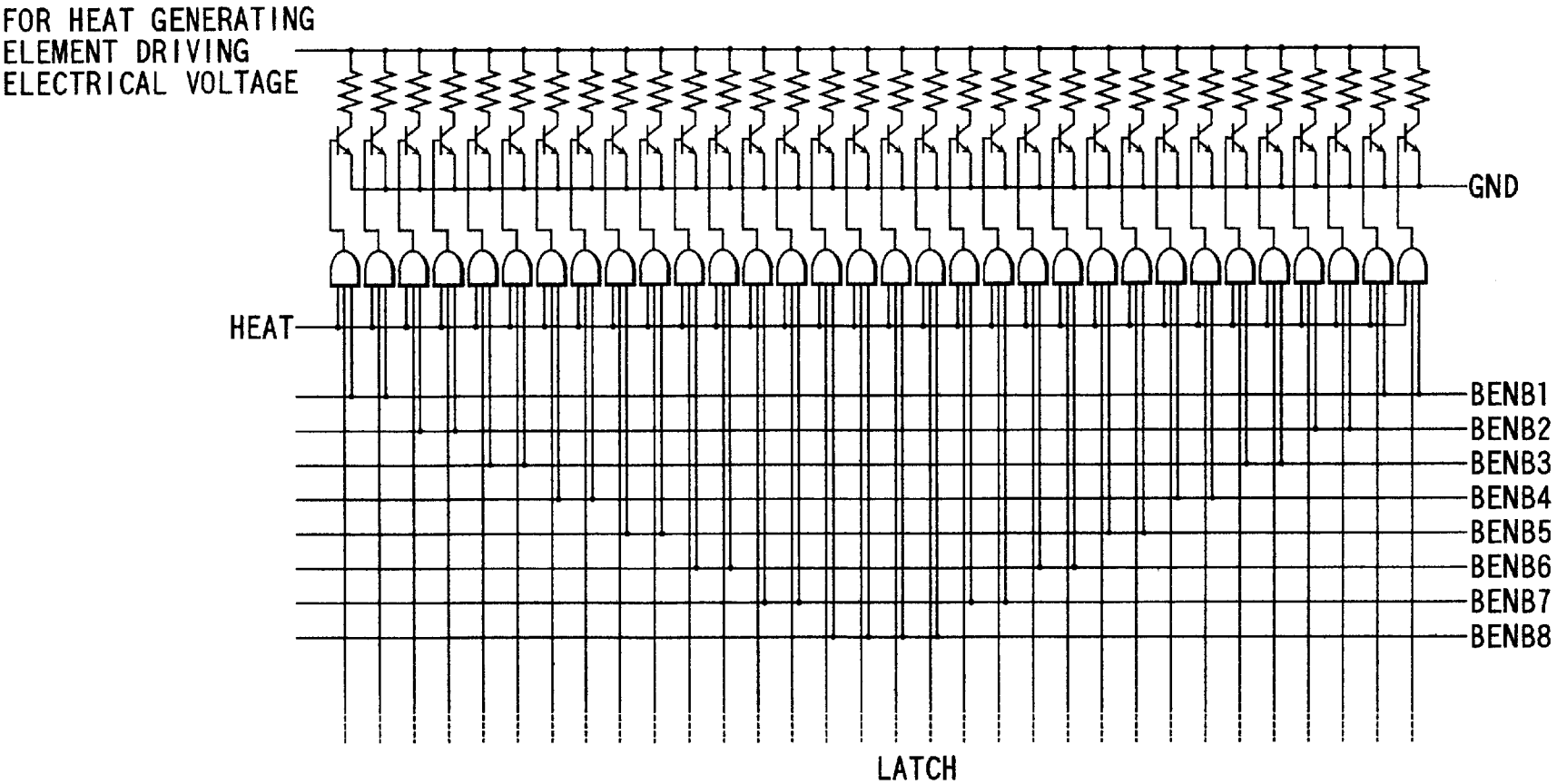
FIG. 13 is a view which schematically shows the equivalent circuit of the elemental substrates in accordance with the present invention.

FIG. 13 shows the equivalent circuit formed on the elemental substrate that performs recording such as this. For the present embodiment, too, when the signal shown in FIG. 11 is inputted, two each of heat generating elements are selected to be ready for driving one after another from both ends of elemental substrate toward the central part of the elemental substrate. Therefore, in accordance with the driving method of the present embodiment, it is possible to select the elements adjacent to each other between the elemental substrates, and make them ready for driving simultaneously (essentially at the same time).

Figure 14:
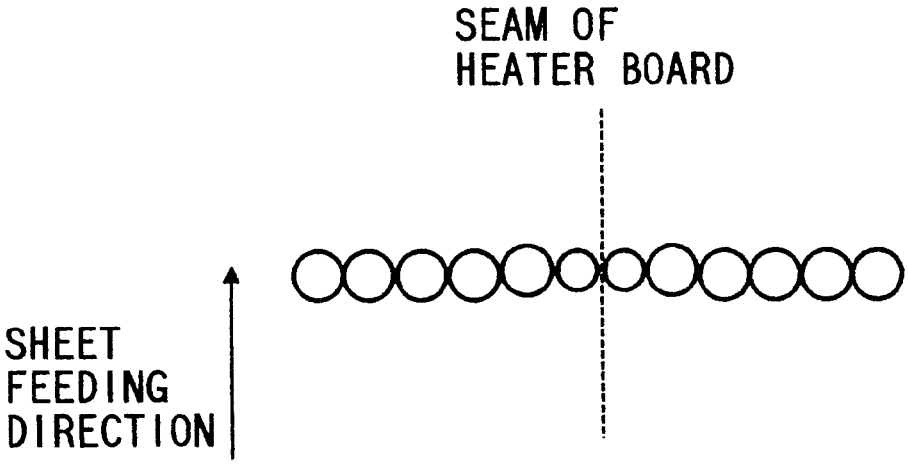
FIG. 14 is a view which shows one example of printed dots in accordance with the present invention.

By the application of this method, the heat generating resistors in the vicinity of the seamed portion of the elemental substrates are driven, and when ink is discharged from nozzles, it becomes possible for the nozzles positioned on both ends of adjacent elemental substrates to discharge ink at the same time. Therefore, the junction of the driving cycles and the seamed portion of the elemental substrates are not caused to agree with each other, and as shown in FIG. 14, the displacement of dots on the seamed portion of the elemental substrates is removed significantly. Also, the discharge pressure exerted by driving the discharge energy generating elements does not easily escape to the common liquid chamber side (toward rear side) in the paths where the discharge energy generating elements are arranged. Hence the pressure is efficiently directed toward the respective orifices. Even when the discharge amount of nozzles at the seamed portion of the heater boards is reduced due to incidental errors in the precision in which the heater boards are arranged as referred to in the description of the related art, it is possible to improve the printing unevenness further because the discharge efficiency of the nozzles is kept in good condition even at the seamed portion of the heater boards.

Figure 15:
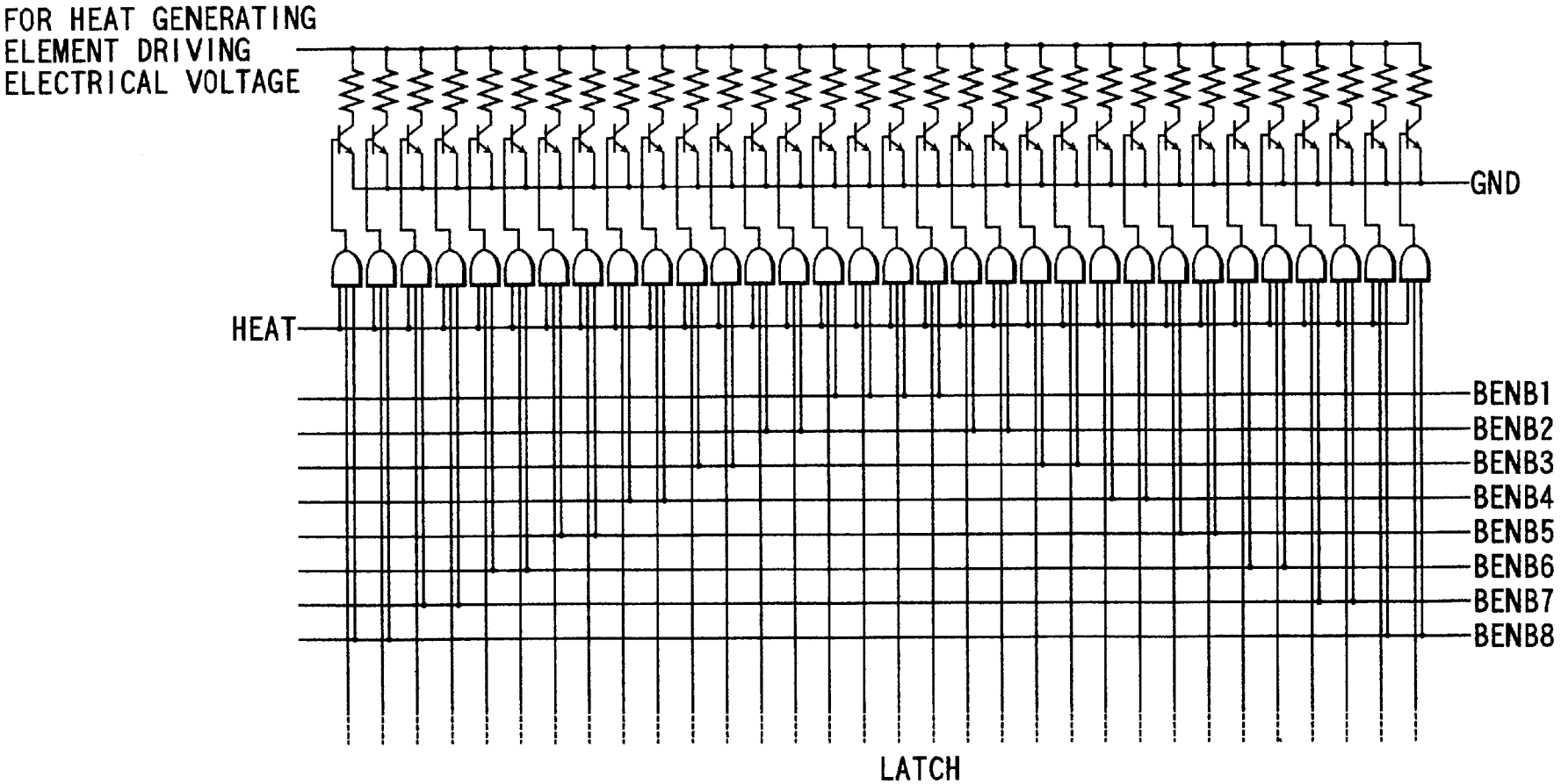
FIG. 15 is a view which schematically shows the equivalent circuit of the elemental substrates in accordance with the present invention.

The embodiment of a driving method, which is attainable as represented in the dot diagram shown in FIG. 7D as well as by the circuit arrangement as represented in FIG. 15, is the same as the driving method shown in FIG. 7C where a plurality of adjacent heat generating resistors are driven one after another. When the signal shown in FIG. 11 is applied to them, two each of the heat generating resistors are selected one after another and made ready for driving from the vicinity of the central part of the elemental substrate to both ends of the elemental substrate.

For the present embodiment, too, the elements in the vicinity of the seamed portion of the elemental substrates are driven simultaneously. Therefore, it is possible to obtain the same effect as the previous embodiment.

Here, for the previous and present embodiments, two each of heat generating resistors are selected one after another and made ready for driving in a pair, but more numbers of heat generating resistors may be made a pair instead or a driving method may be arranged to select each one of heat generating resistors and drive it sequentially if only the resistors adjacent to each other can be selected to be ready for driving simultaneously. In this way, it is possible to obtain the same effect.

Figure 16:
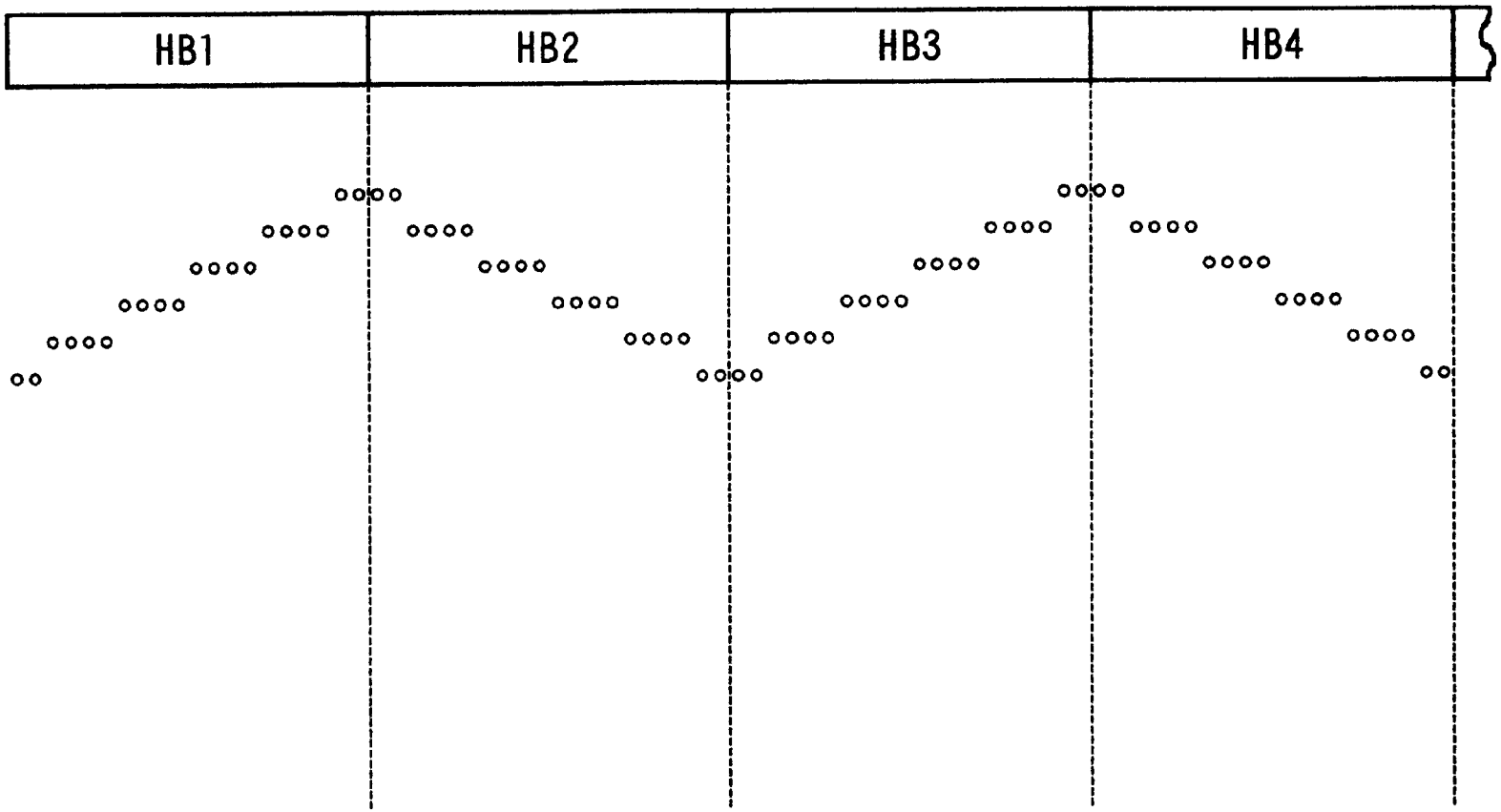
FIG. 16 is a view which schematically shows the driving timing and driving positions in accordance with the present invention.

FIG. 16 is a view which schematically shows the driving timing and driving positions in accordance with still another embodiment.

Figure 17A:
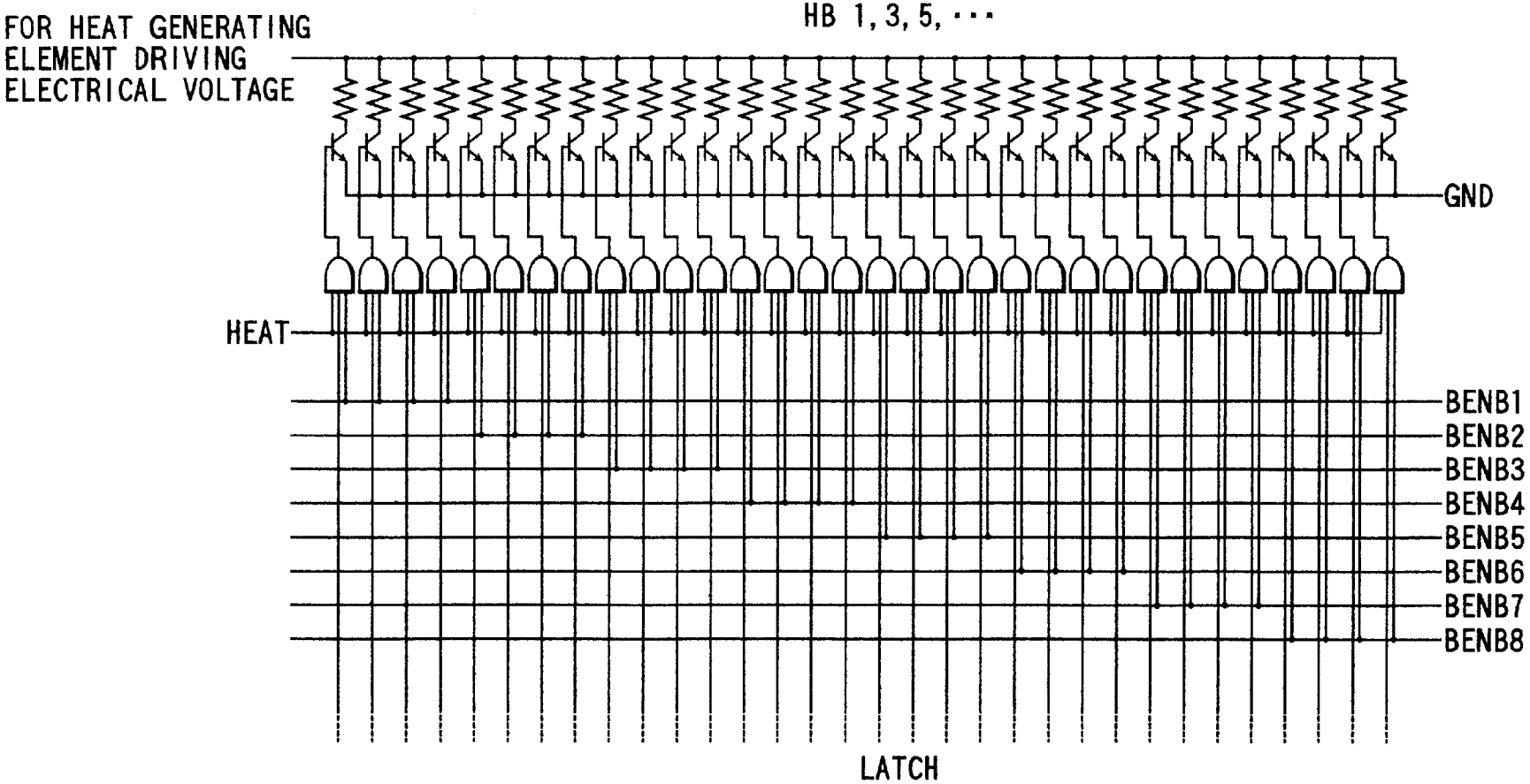
FIGS. 17A and 17B are views which schematically show the equivalent circuit of the elemental substrates in accordance with the present invention.
Figure 17B:
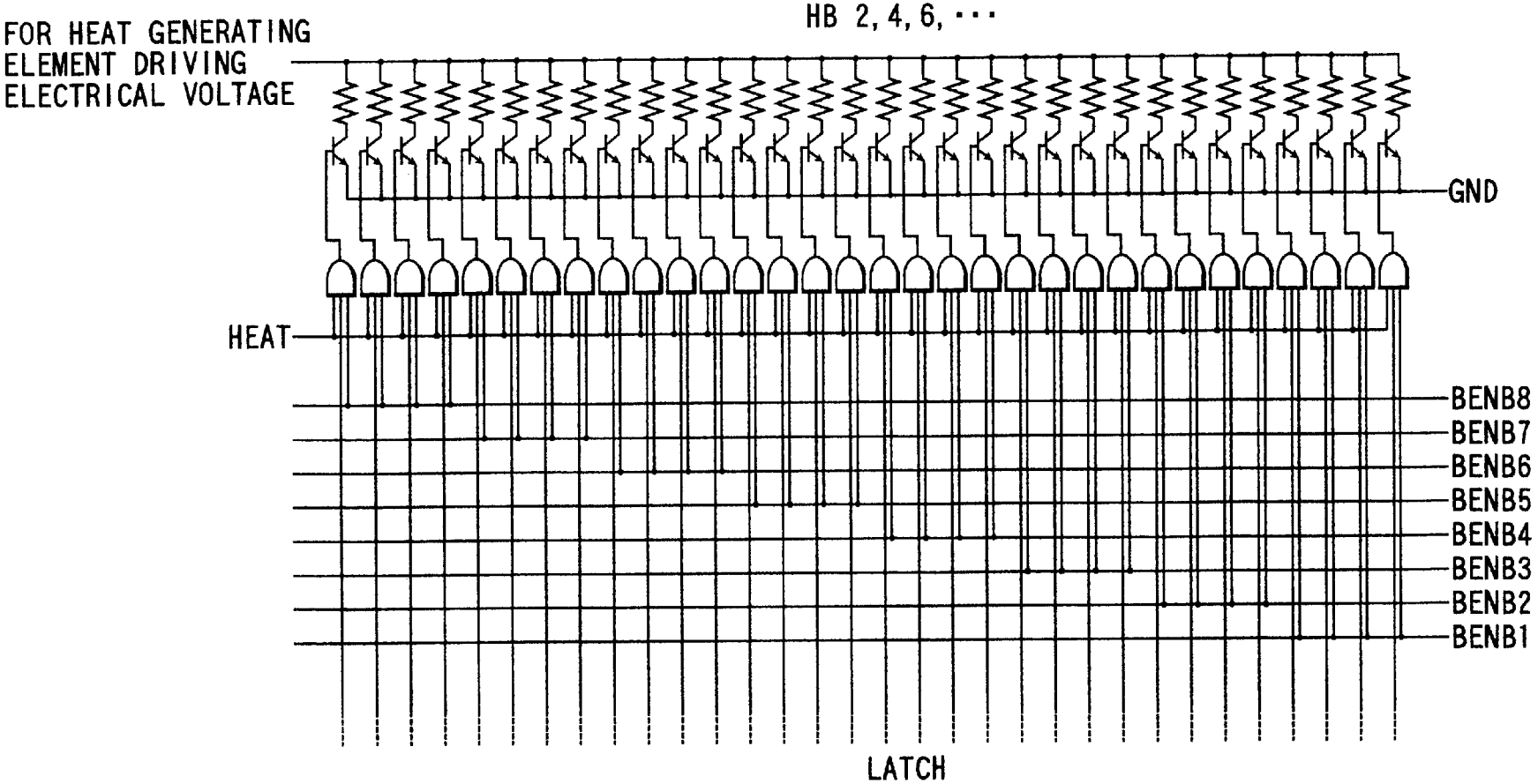

For the present embodiment, it is arranged to start selecting and making the driving ready beginning with every other seamed portion, such as the seamed portion between the elemental substrates HB1 and HB2, and between HB3 and HB4, . . . , and then, to proceed to selecting them to be ready for driving toward the other seamed portion. FIG. 17A is a view which shows the circuit corresponding to the elemental substrates of odd numbers, and FIG. 17B is a view which shows the circuit corresponding to the elemental substrates of even numbers. The driving signal shown in FIG. 11 may be applicable to these circuits.

In accordance with the present embodiment, when nozzles on both end of the seamed portion are to discharge, it is arranged to enable the nozzles on both ends to discharge at the same time as in the previous embodiments shown in FIGS. 7C and 7D. Therefore, the discharge efficiency of those nozzles in each seamed portion is still in good condition.

Also, the first and last blocks to be driven are arranged at a pitch equivalent to one heater board portion in accordance with the previous embodiments shown in FIGS. 7C and 7D, but for the present embodiment, such pitch is made equivalent to a two-heater board portion. As a result, jags are not easily noticeable by eye sight when a straight line is printed, and the good quality of prints is obtainable.

The circuit diagram of each embodiment described above represents the number of heat generating resistors as 32 in order to simplify the illustration, but it may be possible to make it 64, 128, or the like. Also, the number of elemental substrates is represented to be approximately four, but the number is of course made much more. Also, in the circuit diagram of each embodiment described above, the description is made of the number of enable lines as eight, but it may be possible to select the blocks by use of decoders.

Hereinafter, the description will be made of an ink jet apparatus to which the ink jet head of the present invention is suitably applicable.

Figure 18:
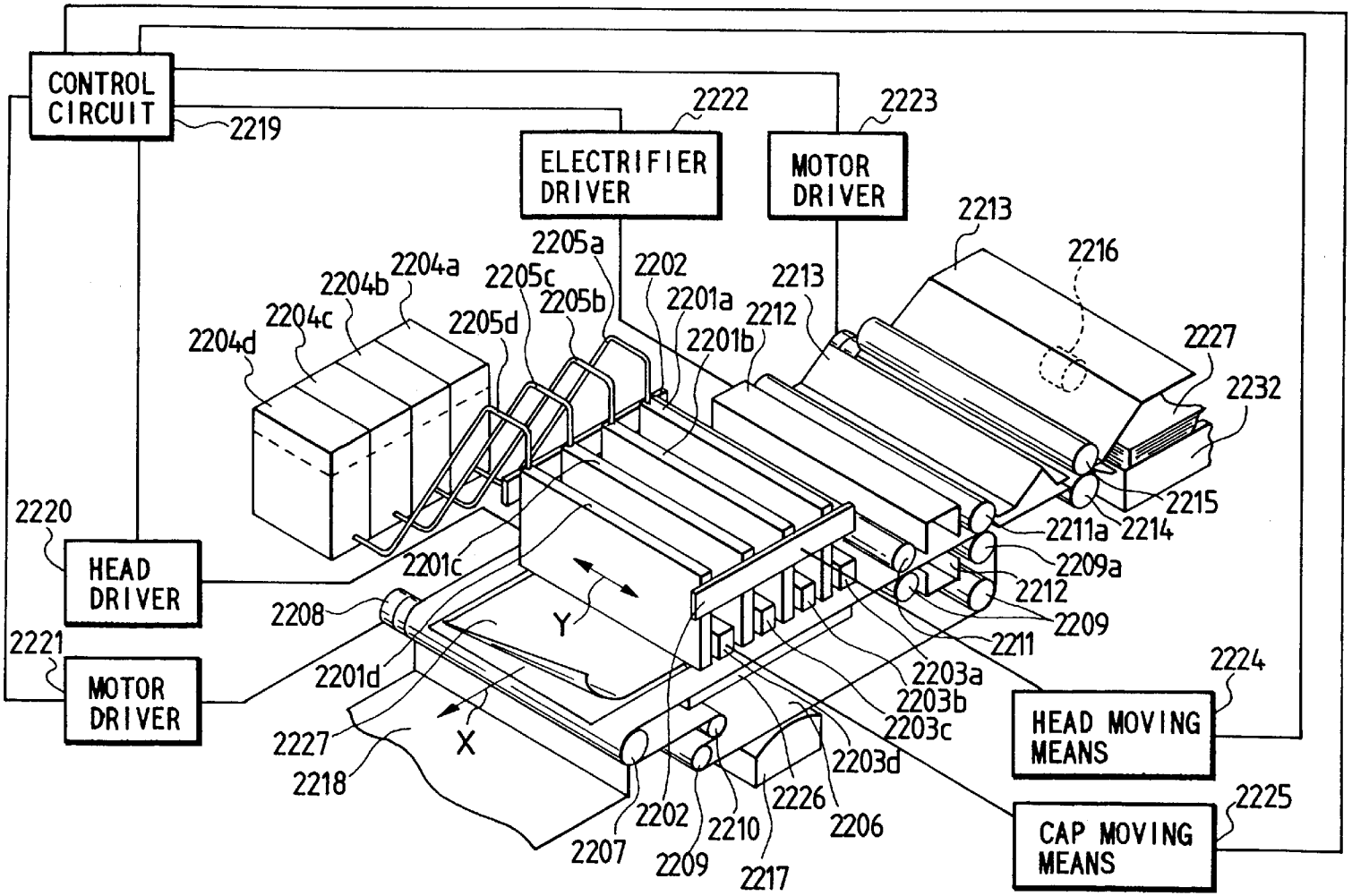
FIG. 18 is a view which schematically shows a recording apparatus in accordance with the present invention.

FIG. 18 is a view which shows one structural example of the ink jet apparatus having the ink jet head of the present invention mounted on it.

As shown in FIG. 18, the ink jet apparatus is provided with line type heads 2201*a* to 2201*d*. These line type heads 2201*a* to 2201*d* are fixedly supported by a holder 2202 at given intervals in parallel to each other in the direction X. On the lower end of each of the heads 2201*a* to 2201*d*, 3,456 discharge ports are arranged in line downward at intervals of 16 discharge ports per mm. Therefore, it is possible to record on the width of 218 mm.

These heads 2201*a* to 2201*d* are of the type to discharge recording liquid by the application of thermal energy, and controlled by means of a head driver 2220.

In this respect, including the heads 2201*a* to 2201*d* and the holder 202, a head unit is formed. The head unit is movable by use of head moving means 224 in the vertical direction.

Also, on the lower part of the heads 2201*a* to 2201*d*, head caps 2203*a* to 2203*d* are arranged, each of which corresponds to each of the heads 2201*a* to 2201*d*, and is arranged adjacent to it at the same time. Each of the head caps 2203*a* to 2203*d* is provided with a sponge or some other ink absorbent in its interior.

In this respect, the caps 2203*a* to 2203*d* are fixed by means of a holder (not shown), and including the holder and caps 2203*a* to 2203*d*, a cap unit is formed. the cap unit is movable by use of cap moving means 2225 in the direction X.

To the heads 2201*a* to 2201*d*, ink, each of cyan, magenta, yellow, and black, are supplied from ink tanks 2204*a* to

2204*d*, respectively, through ink supply tubes 2205*a* to 2205*d*, thus making color recording possible.

Also, this ink supply utilizes the capillary phenomenon of each of the head discharge ports. The liquid level of each of the ink tanks 2204*a* to 2204*d* is set at a level lower than the position of the discharge ports by a specific distance.

Also, this apparatus is provided with a chargeable seamless belt 2206 serving as carrier means for carrying a recording sheet 227.

The belt 2206 is drawn around a driving roller 2207, idle rollers 2209 and 2209*a*, and a tension roller 2210 via a given passage. This belt is connected to the driving roller 2207, and caused to travel by use of a belt driving motor 2208 driven by means of a motor driver 2221.

Also, the belt 2206 travels in the direction X directly under the discharge ports of heads 2201*a* to 2201*d*. Here, the belt is regulated by a fixing and supporting member 2226 so as not to be deviated to the lower side.

A reference numeral 2217 designates a cleaning unit for removing paper dust and other particles adhering to the surface of the belt 2206.

A reference numeral 2212 designates an electrifier to charge the belt 2206. The electrifier 2212 is turned on and off by means of an electrifier driver 2222. The recording sheet is adsorbed or attracted to the belt 2206 by the application of electrostatic adsorption generated by the electrical charge thus taken.

Before and after the electrifier 2212, there are arranged pinch rollers 2211 and 2211*a* to carry and press the recording sheet 2227 to the belt 2206 in cooperation with the idle rollers 2209 and 2209*a*.

A reference numeral 2232 designates a sheet feeding cassette. The recording sheets 2227 in this cassette 2232 is fed out one by one by the rotation of sheet feed roller 2216 driven by means of motor driver 2223, and carried by the carrier roller 2214 and pinch roller 2215 driven by the motor 2223 in the direction X to an angle guide 2213. Also, this guide 2213 is provided with an angled space to bend the recording sheet.

A reference numeral 2218 designates an exhaust sheet tray to receive the recorded sheets.

The head driver 2220, head moving means 2224, cap moving means 2225, motor drivers 2221 and 2223, and electrifier driver 2222 are all controlled by a control circuit 2219.

In this respect, the selection signals (enable signals), image signals, heat signals, and other driving signals, which are described for each of the previous embodiments, are also supplied from this control circuit.

Here, in each of the embodiments described above, while the description has been made of electrothermal transducing elements as discharge energy generating elements, the present invention is not necessarily limited thereto. Piezoelectric elements or the like may be adoptable for use.

As described above, in accordance with the present invention, it is possible for an ink jet recording head, which is structured by providing a plurality of heater boards therefor, to reduce printing unevenness brought about on the seamed portions between heater boards by the way of arranging such heater boards, and to obtain good quality of recorded images.

What is claimed is:

1. An ink jet recording method comprising the steps of:

providing an ink jet head provided with a plurality of elemental substrates linearly arranged in a predetermined direction, each of said substrates having end portions relative to the predetermined direction, and having a plurality of discharge energy generating elements arranged in a line with a portion of said plurality of discharge energy generating elements being disposed on said end portions, the predetermined direction being a direction of the line, the plurality of discharge energy generating elements being divided into a plurality of blocks;

selecting said blocks to be made ready for driving in one cycle one after another and to cause said driving cycle to begin with a discharge energy generating element other than said discharge energy generating elements arranged on said end portions of said elemental substrates; and driving the discharge energy generating elements of the recording head in accordance with said selecting to effect recording.

2. An ink jet recording method according to claim 1, wherein in said driving step, driving is executed based on image data corresponding to discharge energy generating elements in said blocks selected in said selecting step.

3. An ink jet recording method according to claim 1, wherein said discharge energy generating elements are heat generating resistors, and in said driving step, the heat generating resistors are driven in accordance with said blocks selected in said selecting step so that ink is discharged by generating bubbles by application of heat to the ink.

4. An ink jet recording method according to claim 1, wherein the driving step comprises the step of driving four discharge energy generating elements on each of said elemental substrates simultaneously.

5. An ink jet recording method according to claim 1, wherein the driving step comprises the step of driving eight discharge energy generating elements on each of said elemental substrates simultaneously.

6. An ink jet recording method according to claim 1, wherein said substrates each include a central part and said discharge energy generating element other than said discharge energy generating elements arranged on said end portions is on said central part.

7. An ink jet recording method according to claim 1, wherein said driving step comprises the step of simultaneously driving discharge energy generating elements which are adjacent to one another and are provided at the end portions of said elemental substrates.

8. A method according to claim 1, wherein each of said blocks includes one of said discharge energy generating elements.

9. A method according to claim 1, wherein each of said blocks includes more than one of said discharge energy generating elements.

10. An ink jet recording apparatus for recording by discharging ink, comprising:

an ink jet head provided with a plurality of elemental substrates linearly arranged in a predetermined direction, each of said substrates having end portions relative to the predetermined direction, and having a plurality of discharge energy generating elements arranged in a line with a portion of said plurality of discharge energy generating elements being disposed on said end portions, the predetermined direction being a direction of the line, said plurality of discharge energy generating elements being divided into a plurality of blocks;

control means for selecting said blocks to be made ready for driving in one cycle one after another and to cause the driving cycle to begin with a discharge energy generating element other than said discharge energy generating elements arranged on said end portions of said elemental substrates; and driving means for driving said plurality of discharge energy generating elements in accordance with said selecting to effect recording.

11. An ink jet recording apparatus according to claim 10, wherein said ink let head comprises ink paths corresponding to said discharge energy generating elements and discharge ports communicating with said ink paths, said discharge energy generating elements comprise heat generating resistors, and said heat generating resistors discharge ink from said discharge ports by generating and applying heat to the ink to create bubbles in said ink paths to displace the ink.

12. An apparatus according to claim 10, wherein each of said blocks includes one of said discharge energy generating elements.

13. An apparatus according to claim 10, wherein each of said blocks includes more than one of said discharge energy generating elements.

14. An ink jet recording method comprising the steps of:

providing an ink jet head provided with a plurality of elemental substrates linearly arranged in a predetermined direction, each of said substrates having end portions relative to the predetermined direction, and having a plurality of discharge energy generating elements arranged in a line with a portion of said plurality of discharge energy generating elements being disposed on said end portions, the plurality of discharge energy generating elements being arranged in each of said substrates in an arrangement order beginning with end discharge energy generating elements disposed on one of the end portions of said substrate and ending with discharge energy generating elements disposed on the other end of said substrate, the predetermined direction being a direction of the line, and the plurality of discharge energy generating elements being divided into a plurality of blocks;

selecting said blocks to be made ready for driving in one driving cycle one after another such that a driving cycle of discharge energy generating elements corresponding to the driving cycle of said blocks does not begin with the end discharge energy generating elements of each of said substrates; and driving the discharge energy generating elements of the recording head in accordance with said selecting step to effect recording.

15. An ink jet recording method according to claim 14, further comprising the steps of providing image signals corresponding to a portion of said discharge energy generating elements and driving said corresponding discharge energy generating elements.

16. An ink jet recording method according to claim 14, wherein said discharge energy generating elements are heat generating resistors, and further comprising the step of discharging ink by generating bubbles by application of thermal energy from the resistors to the ink.

17. An ink jet recording method according to claim 14, wherein the driving step comprises the step of driving four discharge energy generating elements on each of said elemental substrates simultaneously.

18. An ink jet recording method according to claim 14, wherein the driving step comprises the step of driving eight discharge energy generating elements on each of said elemental substrates simultaneously.

19. An ink jet recording method according to claim 14, wherein said substrates each include a central part and said discharge energy generating element other than said discharge energy generating elements arranged on said end portions is on said central part.

20. An ink jet recording method according to claim 14, wherein said driving step comprises the step of simultaneously driving discharge energy generating elements which are adjacent to one another and are provided at the end portions of said elemental substrates.

21. A method according to claim 14, wherein each of said blocks includes one of said discharge energy generating elements.

22. A method according to claim 14, wherein each of said blocks includes more than one of said discharge energy generating elements.

23. An ink jet recording apparatus for performing recording by discharging ink, comprising:

an ink jet head provided with a plurality of elemental substrates linearly arranged in a predetermined direction, each of said substrates having end portions relative to the predetermined direction and having a plurality of discharge energy generating elements arranged in a line with a portion of said plurality of discharge energy generating elements being disposed on said end portions, the plurality of discharge energy generating elements being arranged in each of said substrates in an arrangement order beginning with end discharge energy generating elements disposed on one of the end portions of said substrate and ending with discharge energy generating elements disposed on the other end of said substrate, the predetermined direction being a direction of the line, and the plurality of discharge energy generating elements being divided into a plurality of blocks;

control means for selecting said blocks to be made ready for driving in one driving cycle one after another such that a driving cycle of discharge energy generating elements corresponding to the driving cycle of said blocks does not begin with the end discharge energy generating elements of each of said substrates; and driving means for driving said plurality of discharge energy generating elements in accordance with the selecting performed by said control means, to effect recording.

24. An ink jet recording apparatus according to claim 23, wherein said ink jet head comprises ink paths corresponding to said discharge energy generating elements and discharge ports communicating with said ink paths, said discharge energy generating elements comprise heat generating resistors, and said heat generating resistors discharge ink from said discharge ports by generating and applying heat to the ink to create bubbles in said ink paths to displace the ink.

25. An ink jet recording apparatus according to claim 23, wherein each of said blocks includes one of said discharge energy generating elements.

26. An ink jet recording apparatus according to claim 23, wherein each of said blocks includes more than one of said discharge energy generating elements.

* * * * *

UNITED STATES PATENT AND TRADEMARK OFFICE

CERTIFICATE OF CORRECTION

PATENT NO. : 6,062,666
DATED : May 16, 2000
INVENTOR(S) : Omata et al.

It is certified that error appears in the above-identified patent and that said Letters Patent is hereby corrected as shown below:

Title page,
Item [56], References Cited,
FOREIGN PATENT DOCUMENTS, "2002009" should read -- 2-2009 --;
"4229278" should read -- 4-229278 --;
"4232749" should read -- 4-232749 --; and
"5024192" should read -- 5-24192 --.

Column 1,
Line 15, "method" should read -- method records --.

Column 13,
Line 9, "let" should read -- jet --.
Lines 49-53, Claim 15 should read as follows:

-- 15. An ink jet recording method according to Claim 14, wherein in said driving step, driving is executed based on image data corresponding to discharge energy generating elements in said blocks selected in said selecting step. --

Lines 54-58, Claim 16 should read as follows:

-- 16. An ink jet recording method according to Claim 14, wherein said discharge energy generating elements are heat generating resistors, and in said driving step, the heat generating resistors are driven in accordance with said blocks selected in said selecting step so that the ink is discharged by generating bubbles by application of heat to the ink. --.

Signed and Sealed this

Twenty-seventh of November, 2001

*Attest:*

Nicholas P. Godici

*Attesting Officer*

NICHOLAS P. GODICI
*Acting Director of the United States Patent and Trademark Office*